United States Patent [19]

Birrell

[11] 3,960,298

[45] June 1, 1976

[54] CONTAINER ASSEMBLY FOR USE WITH A SEPARATOR DISPENSER

[75] Inventor: Peter Leslie Birrell, Delta, Canada

[73] Assignee: The Cornelius Company

[22] Filed: Apr. 19, 1974

[21] Appl. No.: 462,420

Related U.S. Application Data

[62] Division of Ser. No. 300,505, Oct. 25, 1972, Pat. No. 3,828,973.

[52] U.S. Cl. ..... 222/541

[51] Int. Cl.[2] ..... B65D 47/10

[58] Field of Search ..... 220/27, 266, 265, 541; 222/80, 82, 327, 367, 548, 541, 326

[56] References Cited

UNITED STATES PATENTS

| | | | |
|---|---|---|---|
| 2,198,564 | 4/1940 | Robison | 222/82 |
| 2,755,003 | 7/1956 | Sherbondy | 222/327 |
| 3,157,320 | 11/1964 | Sherriffe | 222/80 X |
| 3,307,746 | 3/1967 | Edwards | 220/265 X |
| 3,443,726 | 5/1969 | Muller et al. | 222/80 |
| 3,768,697 | 10/1973 | Lerner | 222/80 |
| 3,828,973 | 8/1974 | Birrell | 222/1 |

*Primary Examiner*—Allen N. Knowles
*Assistant Examiner*—Norman L. Stack, Jr.
*Attorney, Agent, or Firm*—Hill, Gross, Simpson, Van Santen, Steadman, Chiara & Simpson

[57] ABSTRACT

A special replaceable filled container for use in a dispenser, the container having a diaphragm closure, wherein a portion of the closure is to be movably controlled to modulate the flow of the contents such as particulate material therefrom.

11 Claims, 10 Drawing Figures

Fig. 1
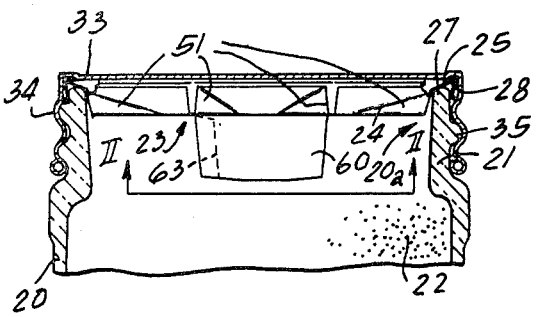
Fig. 6
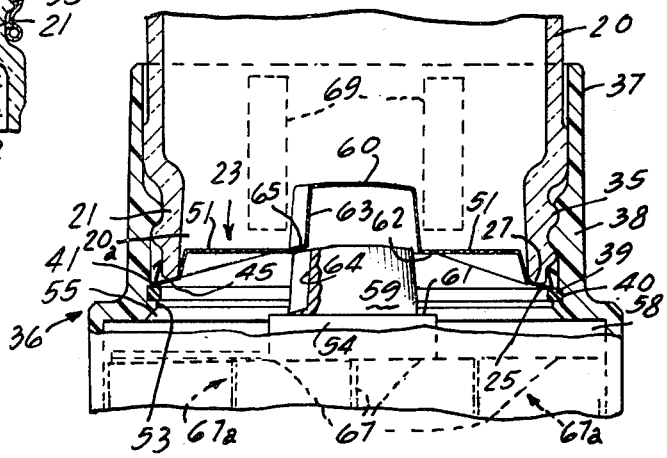
Fig. 4
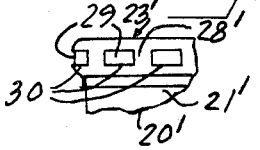
Fig. 5
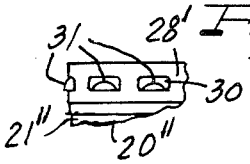
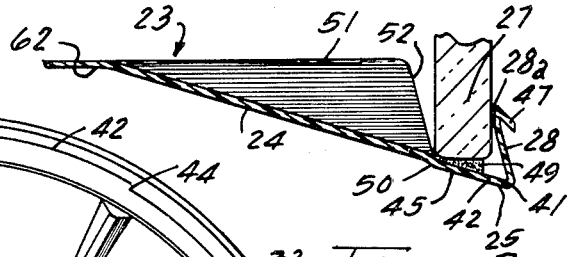
Fig. 3
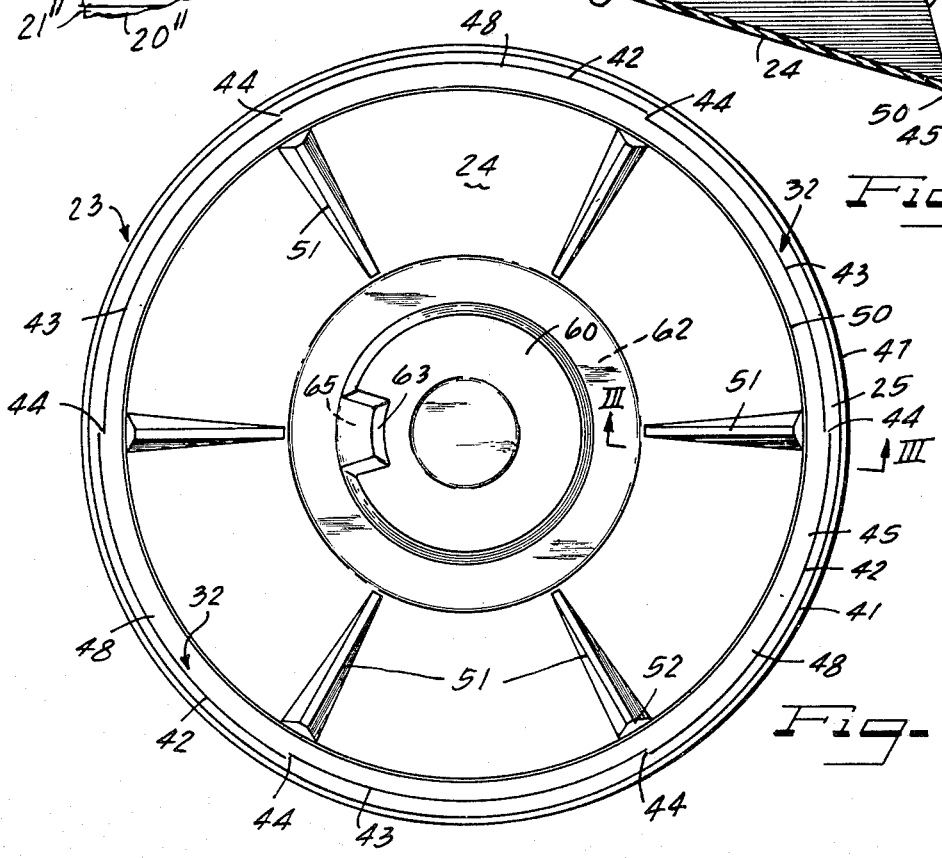
Fig. 2

Fig-7
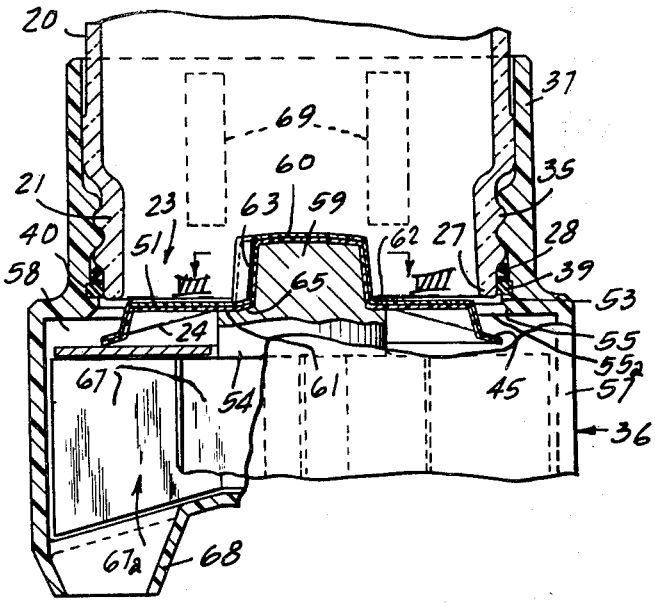
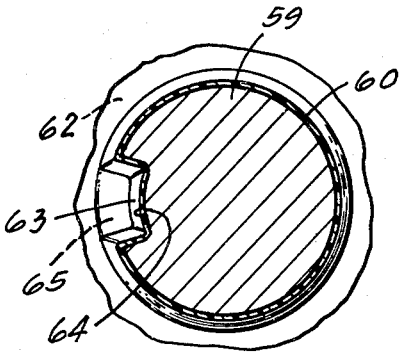
Fig-8
Fig-10
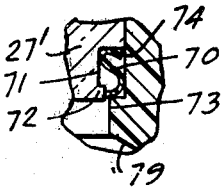
Fig-9
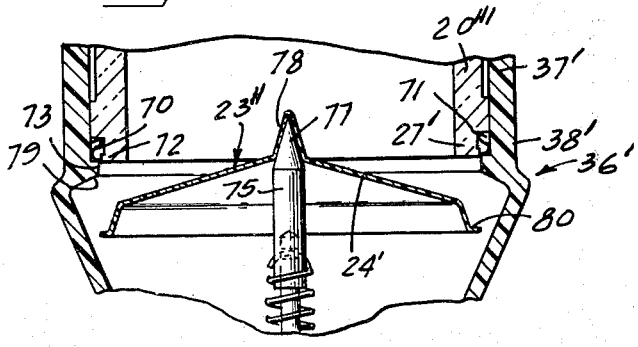

CONTAINER ASSEMBLY FOR USE WITH A SEPARATOR DISPENSER

RELATED APPLICATIONS

This application is a division of my copending U.S. application entitled "Method of and Means for Dispensing", Ser. No. 300,505, filed Oct. 25, 1972, now Pat. No. 3,828,923

FIELD OF THE INVENTION

This invention relates to a filled container assembly wherein a portion of the closure of the container is used to control the flow therefrom when the filled container is installed in a dispenser device.

BACKGROUND OF THE INVENTION

Assurance of genuineness of trademarked products that are dispensed is a matter of concern. Non-reusable sealing closures have been applied to the container to give some degree of assurance in the channels of trade between the time that the container is sealed and the time that it is to be opened by the user. Heretofore, such closures have not been used to function as part of a dispenser to control the flow of contents therefrom.

SUMMARY OF THE INVENTION

An aspect of the invention is to provide a container assembly having a dispensing closure for its discharge end, the container being adapted to be replaceably coupled in an inverted position with a separate dispenser mechanism, the closure comprising a unitary diaphragm member having a central body portion and a continuous margin portion adapted to be secured to the container at its mouth to initially seal it, there being a generally circular line of weakness in said member, said line of weakness being defined by adjacent edges of said portions, said body portion being a prospective modulating element for cooperating with the discharge end of the container after opening at said line of weakness, means on one of said portions for cooperating with complemental structure on the dispenser mechanism for effecting relative movement between said portions to effect such opening, and means on said body portion for cooperating with complemental support structure on the dispenser mechanism for effecting relative axial spacing between said portions for determining the effective size of the resulting dispensing opening around said body portion.

Other features and advantages of the invention will be readily apparent from the following descrption taken in conjunction with the accompanying drawings, in which:

ON THE DRAWINGS

FIG. 1 is a fragmentary vertical sectional view showing a container assembly having a closure for dispensing, according to the invention;

FIG. 2 is an enlarged plan view of the inner surface of the closure taken substantially along line II—II of FIG. 1;

FIG. 3 is an enlarged fragmentary sectional view taken substantially along the line III—III of FIG. 2;

FIG. 4 is a fragmentary elevational view showing a modified attachment of the closure to the container;

FIG. 5 is a fragmentary elevational view of a further modified attachment of the closure to the container;

FIG. 6 is a fragmentary vertical sectional view through a dispenser with which the sealed container is associated;

FIG. 7 is a view similar to FIG. 6, but showing the closure in the dispensing mode;

FIG. 8 is a fragmentary sectional view taken substantially along the line VIII—VIII of FIG. 7;

FIG. 9 is a fragmentary vertical sectional view showing a modified dispenser, closure and container arrangement; and FIG. 10 is an enlarged fragmentary view of a portion of FIG. 9.

AS SHOWN ON THE DRAWING

As shown in FIG. 1, a container assembly includes a container such as a glass jar having a mouth 20*a* or discharge opening through a neck 21 which comprises the closure end of the container 20, there being particulate flowable material 22 such as coffee therein. The mouth 20*a* is closed by a diaphragm closure 23 of unitary construction which comprises a tamper resistant non-reusable seal.

As shown in FIG. 2, the diaphragm closure 23 has a central movable body portion 24 surrounded by a continuous margin portion 25 which, as shown in FIGS. 1 and 3, is engageable with a lip 27 of the container 20. The closure 23 has a flange 28 on its margin 25 and in this embodiment has an annular formation of cement 28*a* sealing the flange 28 to the lip portion 27 of the container 20. The closure 23 is made by vacuum forming and comprises thermoplastic sheet material haviang a typical thickness of 0.010 inch, and may also comprise high impact styrene film. A negative pressure within the container 20 may supplement or replace the cement 28*a*.

The flange 28 may be secured to the container by other structure such as shown in FIGS. 4 and 5. In FIG. 4, a laterally projecting lip-bead 29 of the container 20' is of complementary shape to the flange 28' which is snapped thereover, after which the seal 23' is heat shrunk. A number of spaced holes 30 are provided in the flange 28' to ease assembly of the seal 23' to the container 20'.

As shown in FIG. 5, a container 20' has a series of retaining projections 31 received in the holes 30. Optionally, the holes 30 and the projections 31 are not uniformly spaced, but are arranged in complementary relation to each other according to a product identification code. An attempted mismatch should damage the closure and should cause interference with reception in a dispenser.

As shown in FIG. 1, a conventional cap 33 having threads 34 that match a set of threads 35 on the neck 21 is provided for use during shipment to prevent inadvertent or premature opening of a rupturable connection 32 (FIG. 2) in the closure 23. With the cap 33 removed and the container 20 inverted, the closure 23 remains attached to the container 20 and the weight of the contents does not rupture or open the connection 32 so that the filled container assembly can be inverted for subsequent dispensing through the closure 23 which is then the lower surface of the container 20.

As shown in FIG. 6, a dispenser or dispensing mechanism includes a housing 36 having a collar 37 which has internal threads 38 complemental to the container threads 35.

Means are provided on the dispenser housing 36 for opening the closure 23. In this embodiment, two such means are provided which may work independently of each other or in conjunction with each other. A resilient O-ring 39 of substantially square radial cross section has a flat shoulder directed toward the closure 23, the O-ring 39 being in a groove 40. An annular shoulder 41, best seen in FIG. 3, is engageable with the flat shoulder surface on the O-ring 39 for removing the margin portion 25 by the shearing action of the lip 27 and O-ring 39. The sheared off margin portion 25 is squeezed between the lowermost thread and the O-ring 39 to provide a degree of sealing analogous to that described below in relation to FIG. 10.

To facilitate such shearing, as shown in FIG. 2, the lower surface of the container 20, here the closure 23, has a generally circular line of weakness 42,43 defined by the closure portions 24,25. In this embodiment, the line of weakness comprises a set of outer slits 42 which may be fully or partially severed and a set of inner slits 43 alternately arranged therewith. The slits 42,43 extend angularly so as to be substantially or immediately adjacent to each other, but because of the ends of adjacent slits 42,43 being offset from each other, a set of integral spoke-like connections 44 are provided between the central body portion 24 and the annular margin portion 25.

Immediately radially inwardly disposed from the slits 42, 43, there is an annular sealing area 45 having a ring of sealing material 49 thereon. As the line of weakness 41,42 has a greater diameter than the inside diameter of the mouth 20*a*, the body portion 24, when reengaged with the container 20 can reclose the same. The annular flange 28 on the margin portion 25 has a further annular flange 47. When the sealing area 45 has been thrust past the ring 40, a set of wiper tongues 48 which partially define the slits 42 provide resistance for movement of the body portion 23 past the O-ring 39.

As shown in FIG. 3, the radially inner margin of the sealing area 45 merges into an annular centering and stiffening flange 50. The body portion 24 has a number of projections which extend toward the interior of the container 20 including a set of vane-like ribs 51, there being one such rib 51 aligned with each of the spoke-like connections 44. The ribs function as stiffening devices but also as impellers or stirrers of the contents. The ends 52 of the ribs 51 comprise oblique end faces which in conjunction with or in place of the flange 50 serve as a centering means. The ends 52 jointly define a number of points on a frustoconical configuration or locus.

The housing 36 has a shoulder 53 which partially defines the groove 40 and which also serves to limit the distance which the container 20 can be moved into the housing 36.

The other means for opening the closure 23 includes a rotatable spindle 54 disposed centrally in a dispensing chamber 58 defined by a wall 57 (FIG. 7) of the housing 36. When the closure 23 has been opened as shown in FIG. 7, a shoulder 55 which is the underside of the shoulder 53 and the annular sealing area 45 jointly define an annular orifice 55*a* which extends about the detached body portion 24 which is then remote from its original sealed position and spaced axially from the container surface where the line of weakness 42,43 was initially disposed.

The spindle 54 has a centering boss 59 of frustoconical configuration on which a frustoconical indentation or embossment 60 of the body portion 24 is supported. (In FIG. 7, there is shown two body portions 24, the one nested within the other, illustrating that the dispenser has a capability of supporting more than one such body portions, such as from a prior container.) The spindle 54 has an upwardly directed annular seat 61 which engages and supports the detached body portion 24, engaging an annular seating area 62 on the closure. The embossment 60 and the centering boss 59 are of noncircular horizontal cross section for two purposes: one is to provide an angular drive therebetween to provide corotation and the other is to provide predetermined complementary formations to serve as further coding means whereby the trademarked product in the container will be the same as may be identified on the outside of the housing 36. A representative construction includes a keying rib 63 on the embossment 60 which extends radially inwardly and is received in a keying groove 64 in the centering boss 59 to function as part of the opening means. If the key 63 and groove 64 are not initially aligned, a shoulder 65 at the lower end of the key 63 will engage the upper end of the centering boss 59 which forms part of the support means, but as the closure 23 is flexible the rupturable connection 32 may not sever. However, when the spindle 54 is subsequently rotated, as soon as the groove 64 becomes aligned with the rib 63, these elements interfit axially and then there is positive rotational driving movement to sever the movable body portion 24 from the margin portion 25. It should be expected that the relative axial movement between these portions will sever the connection 32, and if it does, the subsequent rotation of the spindle 54 will effect alignment of the groove 64 with the key 63 to permit the body portion to drop to the remote position as illustrated in FIG. 7.

A number of radial vanes 67 carried by the spindle 54 divide the dispensing chamber 58 into individual movable volumetric metering pockets 67*a*. The upper ends of each pocket 67*a* is open to receive material from the dispensing orifice 55a and those pockets are closed at the bottom thereof by the housing 36. The pockets 67*a* are moved in angular increments so that one of them becomes aligned with a chute 68 for discharging the material, closed at its upper end.

In this embodiment, the collar 37 has a number of spillout openings 69 which extend vertically into the portion of the collar where the threads 38 are located. If an attempt is made to reuse the container 20 after it has been refilled, on inversion thereof before the threads can be interengaged, contents will spill out through the openings 69. The threads between the container 20 and the housing 36 may also be judiciously selected to comprise part of the coding structure. The container 20 and the housing 36 may have a straight-in sliding fit as shown in FIG. 9.

With the detached body portion 24 supported to define the annular orifice 55*a*, the body portion 24 is moved with respect to the container in an axial or angular direction so as to agitate the material to break up bridging so as to assist but to govern the flow of the material therethrough. The upper surface of the body portion 24 is frustoconical, there being approximately a typical slope of 15° and this slope aids material flow.

As shown in FIG. 3, the slope of the end 52 of the rib 51 enables substantial flexing of the seal without interference occurring whereby distortion is avoided. The connection 32 having been opened, the wiper tongues 48 in cooperation with the ring 39 also serve to assist in breaking any vacuum by the mere slight withdrawl of the container 20 by stripping the body portion 24 therefrom.

In this embodiment, the upper surfaces of the ribs 51 lie in a common plane so that the radially outer ends of the ribs are thicker than the inner ends thereof. However, this is not an essential feature as the rib in a proper embodiment can even be omitted as shown in FIG. 9.

In the modification of FIG. 9, the closure 23'' has its outer margin trapped in a peripheral groove 71 defined in part by an annular rib 72 on the container 20''' and a shoulder 73 on the dispenser housing 36' which coact in shear relation to comprise opening means. The container 20''' has a shoulder 74 (FIG. 10) which has stop functions and the severed marginal portion of the closure 23 is thus trapped to form a seal. The support means is provided by a stem or spindle 75 having a boss or conical tip 77 received in a complemental embossment 78 of the closure 23''. An annular area 79 and an annular reinforcing and metering flange 80 define the dispensing orifice surrounding the body portion as previously described. Surrounding the portion 80, there is a frustoconical locus, a number of points on which have a centering function similar to that of the rib ends 52.

Movement of the inverted filled container 20' to the position illustrated fractures the closure member 23'' so that its body portion 24' may drop to a position of support as illustrated.

It will be understood that variations and modifications may be effected without departing from the spirit and scope of the novel concepts of this invention.

I claim as my invention:

1. A container assembly for use with a separate dispenser, comprising: a container initially filled with flowable particulate material; mounting means on the container at its discharge end adapted for detachably making said container coactive with structure on the dispenser; and a unitary diaphragm closure initially closing the discharge end of the container and having a rupturable circular line of weakness defining a prospective relatively axially displaceable body portion having the physical properties enabling it to be used in the dispenser to modulate an annular flow of the material through said discharge end.

2. A container assembly according to claim 1 in which said circular line of weakness has a diameter larger than the inside diameter of said discharge end whereby on axial displacement of said body portion, whether previously ruptured or not, the entire discharge end is opened and whereby a peripheral flange is provided on said body portion for optional reclosing thereof.

3. A container assembly according to claim 1 in which said circular line of weakness comprises a plurality of separate arcuate portions having adjacent ends which terminate angularly adjacent to and radially offset from each other and defining spoke-like connections.

4. A container assembly according to claim 3 in which adjacent ones of said arcuate portions have different diameters, thereby, on rupture, providing a set of wiper tongues.

5. A container assembly according to claim 2 in which an annular area of sealing material is disposed on said peripheral flange of said body portion for sealing the connection between the diaphragm and the container.

6. A container assembly according to claim 1 in which said body portion has a hollow indentation projecting into said discharge end and receptive of external means-for-acting-on-said-body-portion, and about which means the material can flow.

7. A container assembly according to claim 6 in which said indentation is disposed centrally of said body portion and is of generally frustoconical configuration.

8. A container assembly according to claim 6 in which said indentation is of noncircular cross-section receptive of a complementary configuration on the external acting means.

9. A container assembly according to claim 6 in which said indentation comprises at least one hollow radial rib.

10. A container assembly according to claim 9 in which said line of weakness has ends adjacent to each other in angular alignment with said rib.

11. A container assembly according to claim 6 in which said indentation includes a plurality of surfaces jointly lying in a frustoconical locus for centering said closure with respect to said discharge end.

* * * * *